US006366261B1

(12) United States Patent
Stout et al.

(10) Patent No.: US 6,366,261 B1
(45) Date of Patent: Apr. 2, 2002

(54) METHOD AND APPARATUS FOR OVERMOLDED ANTENNA

(75) Inventors: Gary H. Stout, Farmington; Ryan A. Kunz, Roy, both of UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/657,385

(22) Filed: Sep. 8, 2000

(51) Int. Cl.[7] ..... H01Q 1/42; H01Q 1/24
(52) U.S. Cl. ..... 343/872; 343/702
(58) Field of Search ..... 343/872, 702, 343/795, 906, 905, 700 MS; H01Q 1/42, 1/24

(56) References Cited

U.S. PATENT DOCUMENTS

| | | | | |
|---|---|---|---|---|
| 4,255,735 A | | 3/1981 | Liautaud | 336/192 |
| 4,725,395 A | | 2/1988 | Gasparaitis et al. | 264/250 |
| 5,469,178 A | | 11/1995 | Nguyen et al. | 343/702 |
| 5,495,262 A | | 2/1996 | Klebe | 343/853 |
| 5,507,012 A | | 4/1996 | Luxon et al. | 455/89 |
| 5,666,125 A | | 9/1997 | Luxon et al. | 343/702 |
| 5,709,832 A | * | 1/1998 | Hayes et al. | 264/271.1 |
| 5,724,717 A | * | 3/1998 | Gherardini et al. | 29/600 |
| 5,841,401 A | | 11/1998 | Bodley et al. | 343/700 |
| 5,929,819 A | | 7/1999 | Grinberg | 343/754 |
| 6,049,463 A | | 4/2000 | O'Malley et al. | 361/760 |
| 6,052,889 A | | 4/2000 | Yu et al. | 29/600 |
| 6,181,282 B1 | * | 1/2001 | Gans et al. | 343/702 |

* cited by examiner

*Primary Examiner*—Hoanganh Le
(74) *Attorney, Agent, or Firm*—Workman, Nydegger & Seeley

(57) ABSTRACT

A generally planer antenna structure for connecting to a transceiver is provided with the antenna structure having a printed circuit board including a radiating element etched or fabricated thereon. The printed circuit board and radiating element are thereafter encapsulated within an overmolded sheath which provides a protective enclosure for the antenna elements while maintaining the desirable thin profile of the generally planer antenna structure. The antenna structure is created by forming a printed circuit board having the overall general desirable dimensions and affixing thereto a radiating element capable of propagating and receiving the desirable frequency spectrum. The printed circuit board and radiating element are insert injection molded to form the overmolded sheath thereabout. A portion of the printed circuit board having an interface connector for the transceiver is enclosed using a multi-piece housing.

20 Claims, 6 Drawing Sheets

METHOD AND APPARATUS FOR OVERMOLDED ANTENNA

BACKGROUND OF THE INVENTION

1. The Field of the Invention

The present invention relates to reduced-size antennas and the manufacturing thereof. More particularly, the present invention relates to the structure and fabrication of thin-profile, compact antenna configurations.

2. The Background of the Invention

Antenna structures have long manifest themselves as large protuberances and often as extendable metallic projections from the electronic equipment which they service. Antennas, while essential for transmitting and receiving electromagnetic propagable electromagnetic waves, have been both cumbersome and aesthetically undesirable. While it is essential for effective antenna configurations to assume a dimension proportional to the wavelength of the carrier signal, very little advancements have taken place in attending to the minimization of the generally obnoxious nature of antenna structures on portable equipments.

With the advancements of spectrum allocations in higher frequency ranges, antenna structures have benefited from the reduced wavelength of such high frequency signals. That is to say, as electronic devices employ higher frequency spectrums, the associated wavelength, which dictates the effective length of antenna structures, decreases. Therefore, smaller form-factor devices such as wireless telephones, portable transceivers such as those on computing electronics, are capable of assuming desirable integral integrated and miniaturized configurations.

In order to facilitate the integration of antennas into reduced-size electronics, electronics designers have largely resorted to merely placing an otherwise external structure at least partially within the housing confines of the electronic equipment. While such "integration" results in less obtrusive antenna-laden equipment, such advances have not generally attempted to address the manufacturing and structural needs for an ever increasing trend toward integration and miniaturization of electronics.

Another approach for reducing the obvious nature of antenna structures has been to fabricate the radiating elements of antenna structures onto printed circuit boards and integrate those printed circuit boards into the housing of the electronic device. The effectiveness of such planer-structure antenna elements suffer from the directional nature of planer antennas, that is to say, the orientation imposed upon the electronic equipment by the manipulation of a user or otherwise, effects the gain or capability of the antenna. Furthermore, electronic circuitry adjacent to the planer radiating element of the antenna induces interference and further effects the antenna's gain profile. Therefore, it is desirable to create a planer antenna structure that is extendable from interfering electronics. Furthermore, it would be a further advancement in the art to provide an antenna structure and a method for manufacturing an antenna structure that enables a thin-profile planer antenna to be extendable from interfering electronics, thereby presenting an improved gain profile of the antenna while maintaining structural and aesthetic integrity of the electronic product in a miniaturized form-factor environment.

BRIEF SUMMARY OF THE INVENTION

It is an object of the present invention to provide a housing for enclosure of thin-profile planer electronic devices that would otherwise lose their desirable thin dimensions if subjected to traditional enclosure options.

It is another object of the present invention to provide a mechanical stiffner for protecting thin profile planer electronics from exposure.

It is a further object of the present invention to maintain small ergonomic dimensions compatible with integrated miniaturized electronics.

It is yet a further object of the present invention to provide a method for forming an antenna structure from a printed circuit board with a planer radiating element thereon while maintaining the desirable narrow dimensions of the device while still providing a protective housing for enclosing the devices.

An antenna structure for connecting to a transceiver is presented which is comprised of a printed circuit board having first and second sides with distal and proximal ends and a planer electromagnetic radiating element (i.e., the electrical antenna proper). The radiating element, while generally planer, has distal and proximal ends which correspond generally to the distal and proximal ends of the printed circuit board. The proximal end of the printed circuit board provides a connector coupling through cabling such as coaxial cabling to the transceiver which originates transmitting signals and receives signals from the radiating element.

The antenna structure is further comprised of an overmolded sheath which encapsulates both at least a portion of the distal end of the printed circuit board and the distal end of the radiating element affixed thereto. An overmolded sheath is employed for encapsulating the generally planer geometries of the printed circuit board and the radiating element to maintain the generally thin profile of the antenna structure while providing rigidity and protection to the radiating element and printed circuit board. Traditional housing technologies comprised of multiple housing pieces, that undergo subsequent assembly, result in an undesirable and excessive dimension.

Regarding assembly and manufacturing of the overmolded antenna, the overmolded sheath encapsulating the printed circuit board and radiating element is formed, in the preferred embodiment, through an insert injection molding process which allows complete encapsulation of the distal portions of the printed circuit board and radiating element. The overmolded sheath is comprised of flexible plastic, preferably a thermoplastic elastomer, which maintains resilience through moderate flexure of the antenna structure.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
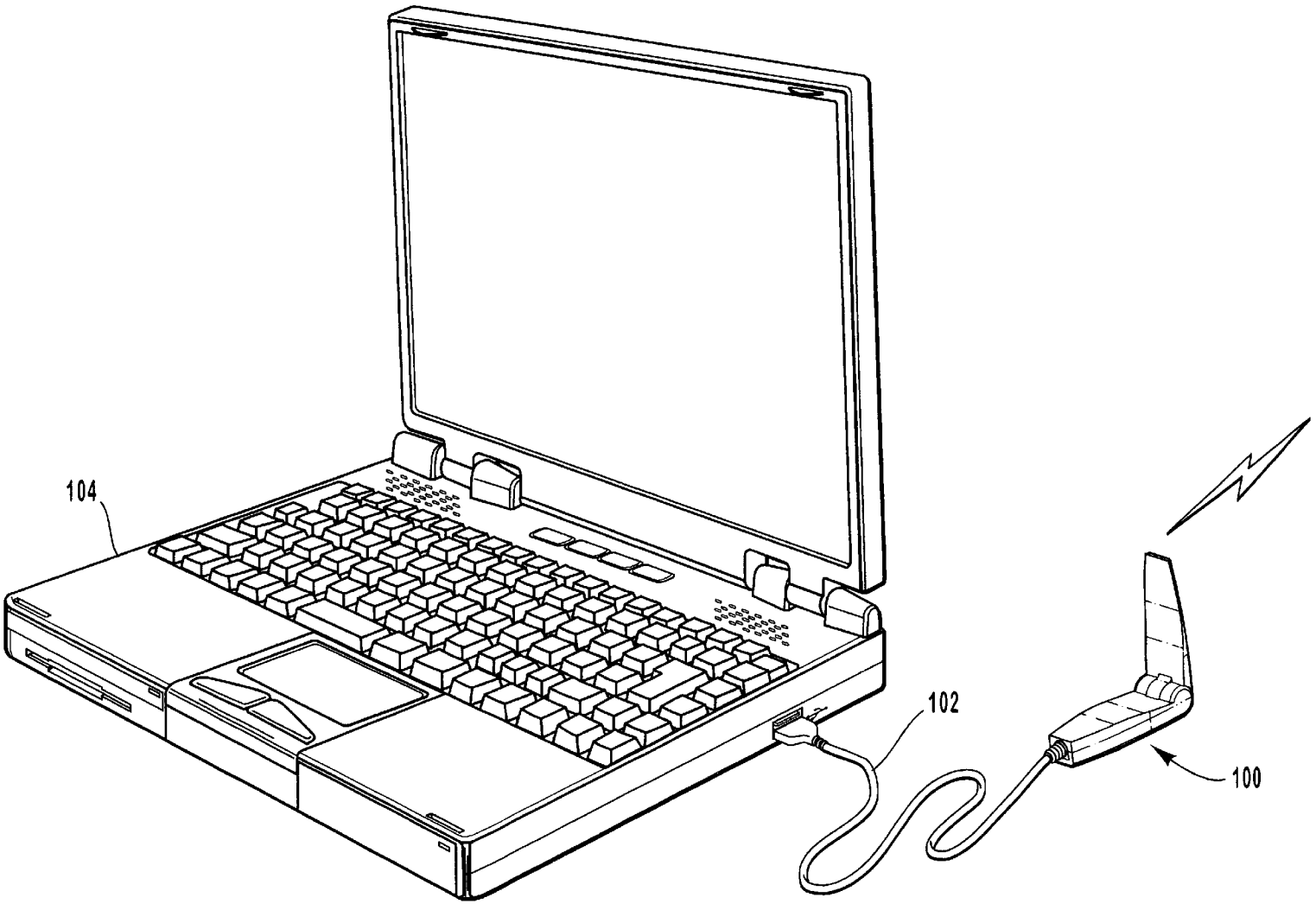
FIG. 1 illustrates a perspective view of a wireless transceiver structure, in accordance with a preferred embodiment of the present invention.

FIG. 1 depicts an environment within which the present invention may be practiced. The present invention finds application to both portable, stationary and embedded transceiver applications where a data exchange is performed over a wireless interface.

FIG. 1 depicts an embodiment of a wireless transceiver structure 100 capable of transmitting and receiving data information originating at a host which, while depicted in FIG. 1 in a personal computer form-factor, may assume various embodiments including hand-held, fixed-site, and embedded applications. FIG. 1 further depicts a cabling or connection 102 between host 104 and transceiver 100.

While discreet separate host and transceiver configurations are depicted in FIG. 1, those of skill in the art appreciate that both the host functionality may be integrated into a transceiver form-factor as well as the transceiver functionality being integrated into a host-like device. One such application of the present invention employs a short-range wireless standard implemented by transceiver 100 for accommodating a wireless network connection by host 104 to a computer network. It is contemplated by the inventors that one specific such short-range wireless standard that may be implemented has come to be known as the "Bluetooth" short-range wireless standard. Those of skill in the art also appreciate that a wireless transceiver device that is capable of providing a desirable high bandwidth air-interface must also have a sufficient bandwidth through the wired interface depicted as connection 102. By way of example, and not limitation, FIG. 1 depicts connection 102 as being a universal serial bus (USB) interface so capable of providing adequate bandwidth between host 104 and transceiver 100.

Figures 2A, 2B, 2C:
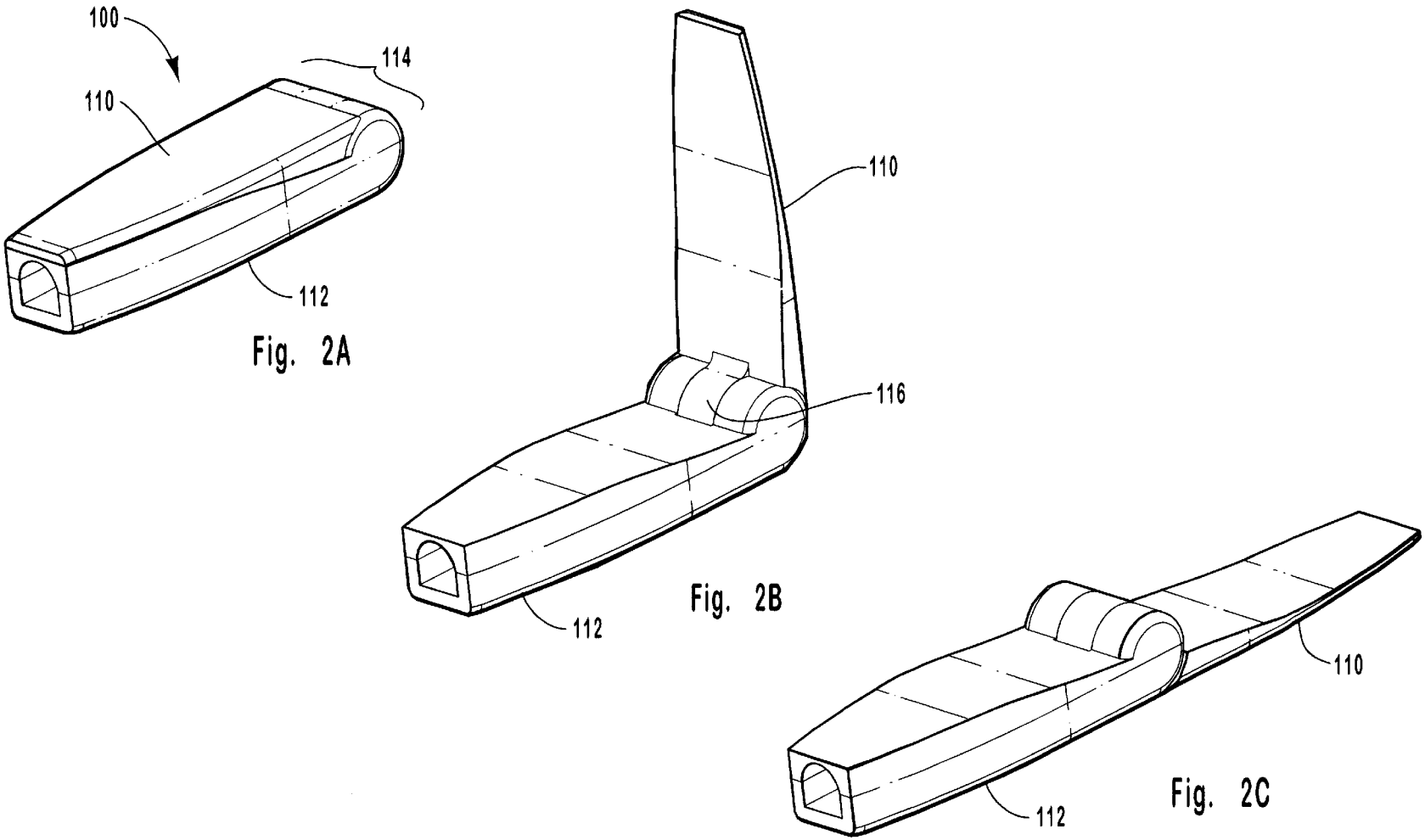
FIG. 2 is a perspective diagram of a transceiver structure having an antenna structure attached thereto, in accordance with a preferred embodiment of the present invention.

FIG. 2 depicts transceiver structure 100 in various active orientations for providing favorable antenna propagation profiles. FIG. 2 depicts transceiver structure 100 as being comprised of a transceiver portion 112 and an antenna structure 110 physically and electrically coupled together through a hinge arrangement 114. FIG. 2*a* depicts transceiver structure 100 in a closed position wherein the antenna structure 110 is in a folded or horizontal position as referenced to transceiver 112. Those of skill in the art appreciate that transceiver structures are typically comprised of transceiver electronics, including a transmitter and a receiver, and an antenna structure capable of radiating electromagnetic energies.

In FIG. 2, by way of example and not limitation, the transceiver electronics are depicted as being included within the transceiver portion 112 while the radiating or antenna elements are included within antenna structure 110. Hinge arrangement 114 accommodates the reorienting of antenna structure 110 into a preferred position for enhancing the propagation patterns in relationship to the corresponding wireless network interface counterpart transceiver (not shown). In FIG. 2*b*, antenna structure 110 is depicted as being extended away from transceiver 112. In the preferred embodiment, antenna structure 110 is comprised of a radiating element (FIG. 5) that is preferably a vertically polarized radiating element. Therefore, antenna structure 110 may be modified in its orientation in accordance with a preferred polarization attitude.

FIG. 2*b* further depicts a hinging component 116 of hinge arrangement 114 that is coupled physically to antenna structure 110 through which electrical contacts pass from antenna structure 110 to transceiver 112. FIG. 2*c* depicts a further orientation position of antenna structure 110 in relationship to transceiver 112 which accommodates the orientation of transceiver 112 in a substantially vertical position allowing antenna structure 110 to be a physical extension of the vertical orientation of transceiver 112.

Figure 5A:
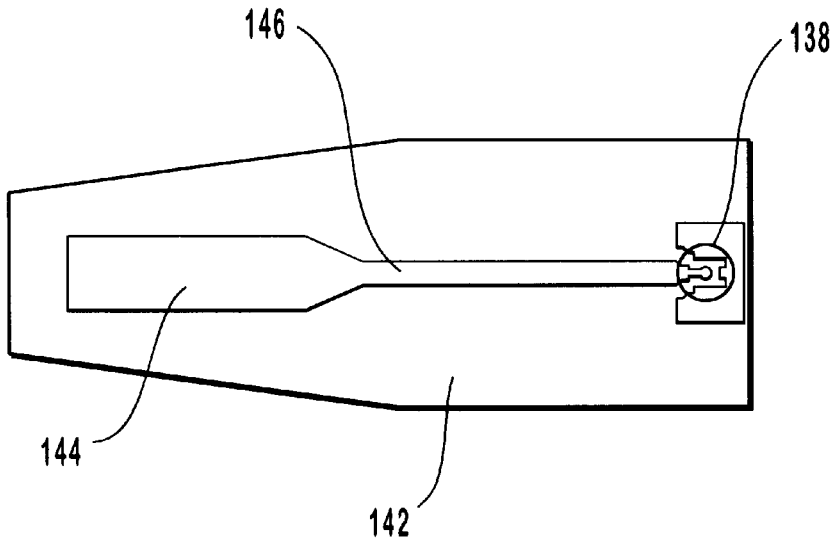
FIG. 5 depicts a radiating element on a printed circuit board, in accordance with a preferred embodiment of the present invention.
Figure 5B:
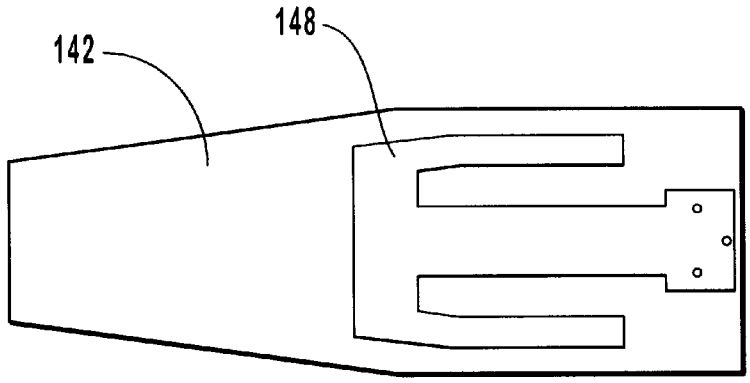

FIG. 2 further depicts the proportionality aspect of transceiver 112 and antenna structure 110 when combined to form transceiver structure 100. That is to say, electronic transmitting and receiving components comprising transceiver structure 112 are generally more physically bulky and substantial in nature, thereby requiring a more significant volume than the volume required by antenna structure 110. In fact, antenna structure 110, as further described in FIG. 5, is largely comprised of a generally planer printed circuit board having a metallic radiating element affixed thereon, or etched therefrom when the printed circuit board is comprised of a metallic exterior layer.

Therefore, it is apparent that the physical housing of the components comprising transceiver 112 and the components comprising the antenna structure 110 exhibit differing requirements. For example, the underlying components of transceiver 112 due to their bulky nature may be housed in a more traditional housing comprised of an aggregate of interlocking pieces generated through traditional injection molding processes. Those of skill in the art appreciate that plastic housings of electronic components are forms of providing a structural enclosure for traditional electronic components disposed on a printed circuit board. In fact, the dimensions as dictated by a housing for a device such as transceiver 112 accommodate the ability of incorporating the structural abutting edges and physical mechanical interfaces for assembly, generally in a clam-shell structure, of various electronic components and features therein.

However, as dimensions reduce, housings for enclosing structures cannot maintain all of the edge and mating profiles necessary for providing the structural integrity of individual components of traditional clam-shell or multi-part enclosures.

Therefore, other enclosure approaches such as those described in the present invention, must be employed to facilitate the physical enclosure of electronic aspects of electronic components and comprise the substance of the present invention. Those of skill in the art appreciate the driving tensions associated with the integration and miniaturization of electronic components resulting in smaller, more compact form-factors of devices such as transceiver structure 100.

Figure 3:
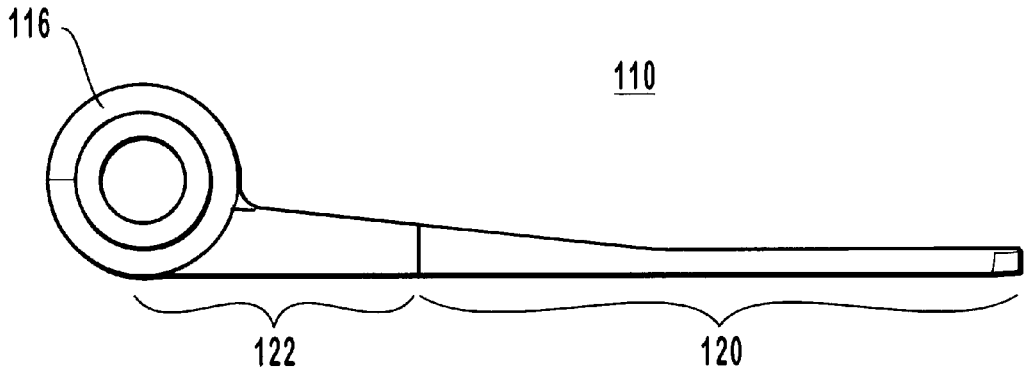
FIG. 3 is a side view of an antenna structure, in accordance with a preferred embodiment of the present invention.

FIG. 3 more clearly depicts the thin or compact thickness dimension of antenna structure 110. Those of skill in the art appreciate that traditional clam-shell housing enclosures for electronic components or features exhibiting a generally planar profile do not lend themselves to such clam-shell based processes or discrete assembly components dictating more bulky packaging. FIG. 3 depicts antenna structure 110 as being comprised spatially of a tapered distal end 120 forming the terminal or extended end of antenna structure 110 and a proximal end 122 adjacent to and for coupling mechanically with transceiver 112 (FIG. 2). It should be apparent from the end view of FIG. 3, that tapered distal end 120 assumes a thin physical profile which is not conducive to a clam-shell housing nor is it conducive to a monolithic separately-molded sheath or housing as such housings must be of sufficient structure and substance to support both the manufacturing of the housing and the integrity of the housing during the assembly and use of the housing and structures therein.

Figure 4:
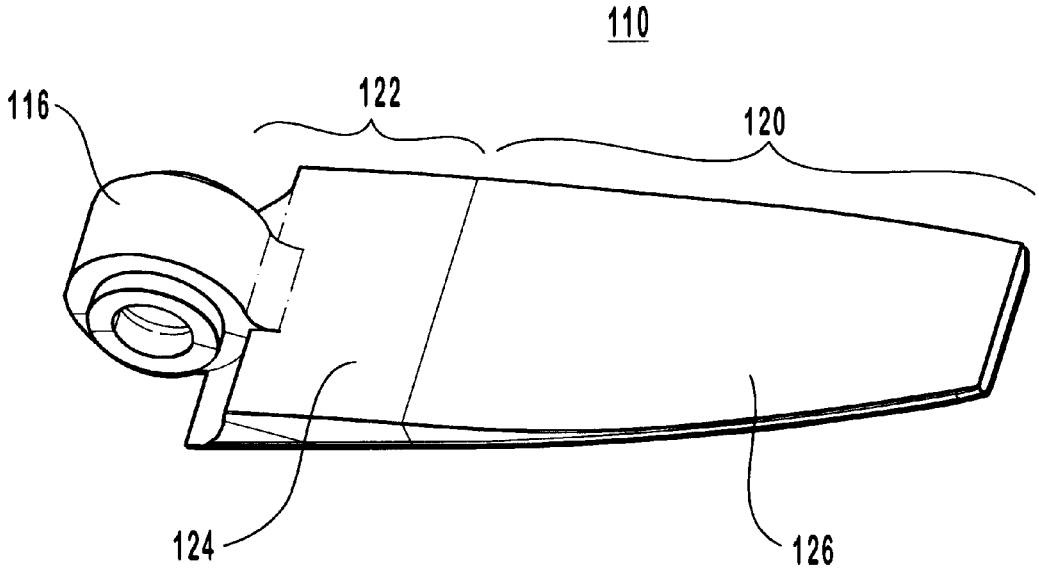
FIG. 4 is a perspective view of an antenna structure having an overmolded portion, in accordance with a preferred embodiment of the present invention.

FIG. 4 depicts a perspective view of antenna structure 110. Due to the fine dimension nature of tapered distal end 120, the electromagnetic radiating element 144 FIG. 5) and the printed circuit board 142 (FIG. 5) which together provide the substrate and antenna radiating element for antenna structure 110 are encapsulated or overmolded by an overmolded sheath 126 which forms an integral covering or "housing" for the distal portions of both the radiating element and the printed circuit board while maintaining the fine/thin dimension of antenna structure 110. It should be appreciated that overmolded sheath 126 facilitates the fine dimensions as dictated by both the trend toward miniaturization and the ergonomic aspect associated with miniaturization.

FIG. 4 further depicts proximal end 122 of antenna structure 110 as comprising an antenna housing 124 coupled about both the proximate portion of the printed circuit board and the proximate portion of the planar electromagnetic radiating element. In the preferred implementation, housing 124 is implemented as a clam-shell housing as such a housing configuration is compatible with the larger thicker dimensions associated with the proximal end 122. Furthermore, a clam-shell housing arrangement facilitates a two part assembly of hinging component 116 about the other hinging components associated with transceiver 112 (FIG. 2). Additionally, housing 124 also facilitates any necessary rework on connecting elements from radiating element 144 to a cabling connector for coupling with transceiver 112. Those of skill in the art appreciate various other coupling techniques for affixing an antenna structure 110 with a transceiver 112 (FIG. 2) by means other than a circular hinging component 116, such as through the use of a flex circuit, circular rotating contacts, or other techniques. Such approaches and solutions are contemplated by the inventor and are considered to be within the scope of the present invention.

The antenna structure 110 for connecting to a transceiver, in the preferred embodiment, is comprised of a printed circuit board, a planer electromagnetic radiating element, and an overmolded sheath which encapsulates at least a portion of both the printed circuit board and the radiating element. FIG. 5 depicts both the printed circuit board and the radiating element of the antenna structure prior to encapsulation by the overmolded sheath. In FIG. 5, a printed circuit board 142 provides a necessary substrate for supporting a generally planer radiating element 144. Printed circuit board 142 further provides additional rigidity for the thin profile of antenna structure 110 and may be ergonomically tapered as illustrated in FIG. 5 to provide an aesthetically desirable silhouette for antenna structure 110.

Antenna structure 110 is further comprised of a planer electromagnetic radiating element 144 which emits propagable electromagnetic waves as originated by the transmitter, and further provides gain to received electromagnetic signals for processing by the receiver. FIG. 5 depicts a printed monopole antenna affixed to printed circuit board 142. FIG. 5 further depicts radiating element 144 being coupled to a connector 138 for interfacing with the transceiver via an interconnect trace 146. It should be appreciated that radiating element 144 and interconnect trace 146, in the preferred embodiment, are formed on printed circuit board 142 through the process of etching elements 144 and 146 from a metallic layer deposited earlier on printed circuit board 142.

By way of example and not limitation, radiating element 144 and interconnect trace 146 assume dimensions for facilitating the transmission of a 2.4 gigahertz signal common to the "Bluetooth" standard. Furthermore, Figure SB depicts printed circuit board 142 having on a second side a ground plane 148 affixed to the printed circuit board for further facilitating the propagation of electromagnetic energies. It should be appreciated that the specific geometries of radiating element 144, 146 and ground plane 148 depict but one specific configuration of a planer antenna structure while various planer antenna structures are contemplated by this invention. Such planer antenna arrangements are available from various antenna manufactures including Rangestar Wireless, Inc. of 9565 Soquel Drive, in Aptos, Calif. 95003.

Figure 6A:
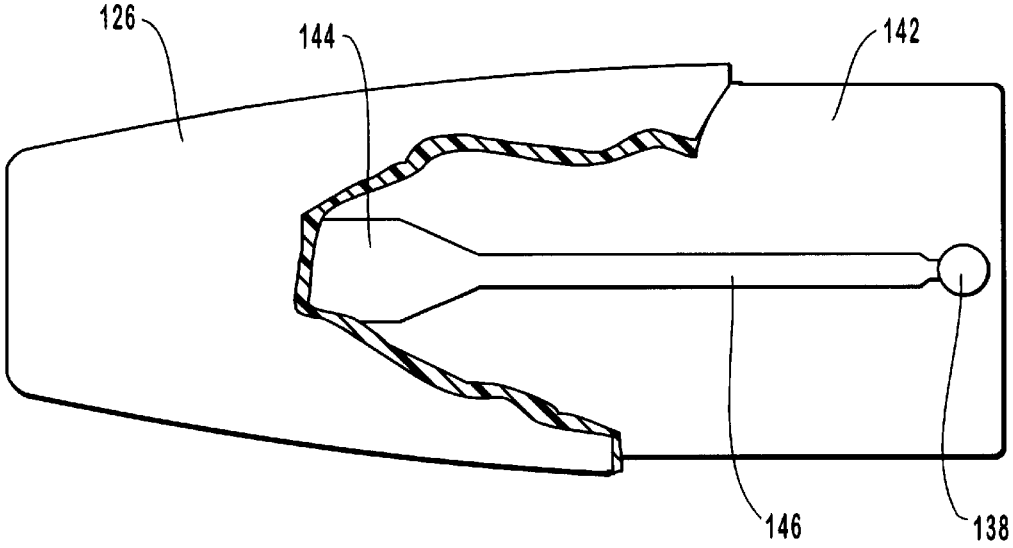
FIG. 6 depicts a cutaway view of an antenna structure having an overmolded encapsulation sheath, in accordance with a preferred embodiment of the present invention.
Figure 6B:
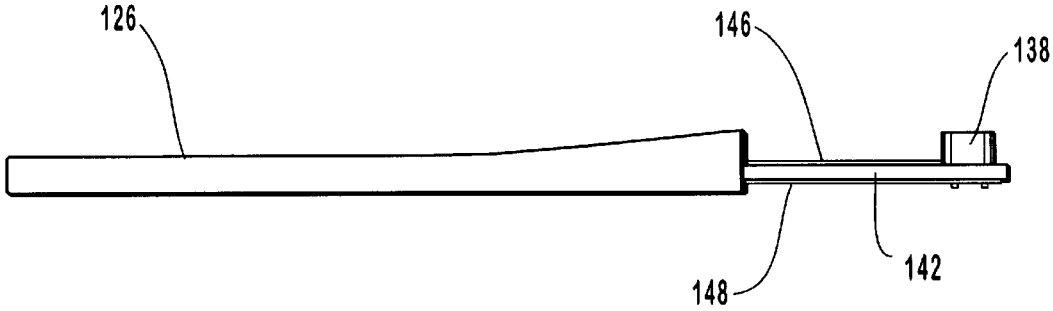

FIG. 6 depicts a cutaway view of antenna structure 110 in a partial state of assembly. In FIG. 6, printed circuit board 142 having radiating element 144 and interconnect trace 146 coupled to connector 138 are at least partially encapsulated by an overmolded sheath 126 which provides the enclosure for at least the thinner profile portions, primarily located at the distal ends of radiating element 144 and printed circuit board 142. Overmolded sheath 126, in a preferred embodiment, is comprised of a single unitary sheath resulting from a single molding or injection process. Overmolded sheath 126 is preferably comprised of molded plastic such as a plastic from the thermoplastic elastomer group or urathane-based groups. One such preferred thermoplastic elastomer is Santoprene 310 available from Advanced Elastomer Systems, LP of 388 South Main Street, Akron, Ohio 44311. While the above-designated elastomer is one preferred composition, various products that are comparably rigid yet pliable with the necessary viscosity for being molded into the overmolded sheath 126 are equally suitable and are contemplated by the inventor as being within the scope of the present invention.

Figure 7:
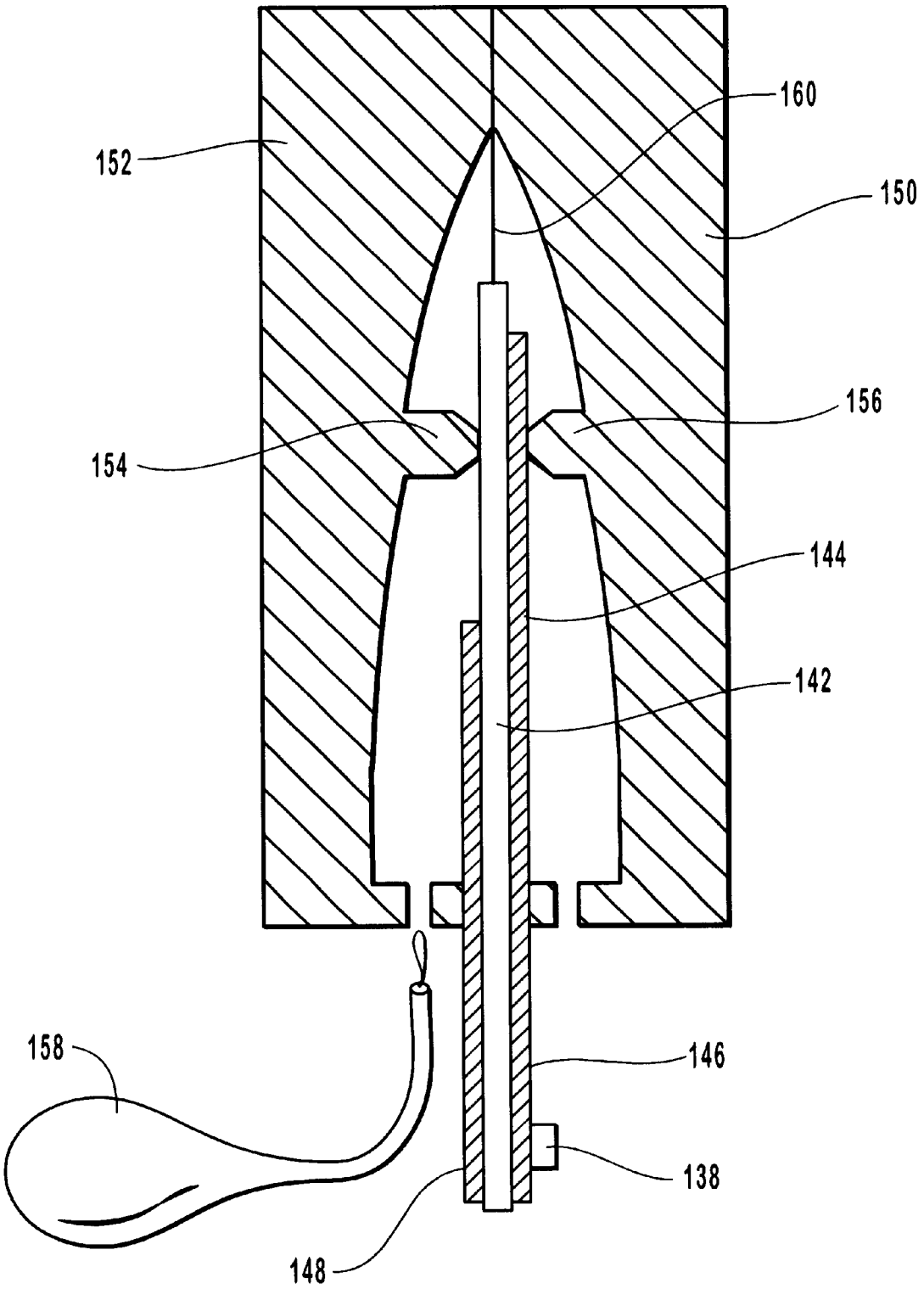
FIG. 7 depicts the molding and forming process for manufacturing an overmolded antenna structure, in accordance with a preferred embodiment of the present invention.

FIG. 7 depicts the method and associated structure for forming an antenna structure 110 for connecting to a transceiver, in accordance with the preferred embodiment of the present invention. As discussed above, antenna structure 110 is comprised of printed circuit board 142 having a radiating element 144 including an interconnection trace 146 and an opposing ground plane 148 formed thereon through etching processes or other processes known by those of skill in the art for forming metallic profiles thereon. That is to say, a printed circuit board is formed for providing the insulative substrate for antenna structure 110 upon which a planer antenna configuration, such as a planer electromagnetic radiating element with its corresponding dimensions requisite for propagating and receiving the desired frequency spectrum, are formed. Furthermore, the antenna structure proper, as described above, is further comprised of overmolded sheath 126 (FIG. 6) which, in the preferred embodiment, is formed by overmolding at least a portion of both the distal end of printed circuit board 142 and the distal end of radiating element 144 to form the distal portion of antenna structure 110. In FIG. 7, the overmolding process is depicted as being performed through an injection mold process employing molds 150 and 152 through an insert-mold process wherein printed circuit board 142 and its metallic antenna components 144, 146 and 148 are inserted prior to the injection process. It should be appreciated that the overall planer nature of printed circuit board 142 and its accompanying metallic components results in a structure that is susceptible to deflection at the distal end during the overmolding process. Therefore, molds 150 and 152 are further comprised of molding supports 154 and 156 for supporting the distal portion of the inserted antenna structure. Once supported, molten plastic depicted as plastic 158 is injection molded in an overmolding process resulting in antenna structure 110.

While a preferred embodiment of the present invention contemplates a single step unitary injection molding process for overmolding both sides of the printed circuit board structure, a two-step process is also contemplated wherein a first half or side of the printed circuit board structure is molded resulting in a first half of the overmolded sheath during a first injection step followed by a second injection step resulting in a second half of the overmolded sheath. Such a process may occur through the insertion of a barrier 160 or through the generation of distinct molding halves for creating both the first half and the second half of the overmolded sheath. When such a two-step process is employed, a follow-up or reflow step is also involved wherein both the first half and the second half are reflowed into a unitary overmolded sheath 126.

The antenna structure may be further comprised of an antenna housing 124 (FIG. 4) coupled about the proximate portion of the printed circuit board and the proximate portion of the planer electromagnetic radiating element for providing access to a connector located on the proximal end of the printed circuit board. The proximal end housing further accommodates a cabling path between the antenna structure and the transceiver as well as providing functional hinging of the antenna structure with respect to the transceiver.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by united states letters patent is:

1. An antenna structure for connecting to a transceiver, comprising:

a) a printed circuit board having first and second sides and distal and proximal ends;

b) a planer electromagnetic radiating element having distal and proximal ends and affixed to said first side of said printed circuit board, said distal end of said radiating element being positioned on said distal end of said printed circuit board and said proximal end of said radiating element being positioned on said proximal end of said printed circuit board, said radiating element capable of electrical coupling to said transceiver;

c) an integral one-piece overmolded sheath that encapsulates both at least a portion of said distal end of said printed circuit board and at least a portion of said distal end of said radiating element affixed thereto forming a distal portion of said antenna structure;

and d) an antenna housing coupled about both said proximate portion of said printed circuit board and said proximate portion of said planer electromagnetic radiating element and abutting said overmolded sheath forming a proximate end of said antenna structure.

2. The antenna structure as recited in claim 1, wherein said overmolded sheath is comprised of injection molded plastic.

3. The antenna structure as recited in claim 2, wherein said molded plastic is a thermoplastic elastomer plastic.

4. The antenna structure as recited in claim 2, wherein said molded plastic is a urathane-based plastic.

5. The antenna structure as recited in claim 1, wherein said planer electromagnetic radiating element further comprises:

a) a ground plane affixed to said second side of said printed circuit board for electrically connecting to said transceiver.

6. The antenna structure as recited in claim 1, wherein said electromagnetic radiating element further comprises:

a) an interconnect trace electrically connected from said proximal end of said planer radiating element to said proximal end of said printed circuit board for electrically connecting said planer electromagnetic radiating element to said proximal end of said printed circuit board and for electrically coupling to said transceiver.

7. The antenna structure as recited in claim 6, wherein a) said planer electromagnetic radiating element and said interconnect trace are proportional for operation of said transceiver at the frequency bands about 2.4 GHz.

8. The antenna structure as recited in claim 6, further comprising:

a) a connector electrically coupled to said interconnect trace and said planer electromagnetic radiating element and physically mounted to said printed circuit board for cabling to said transceiver.

9. A method for forming an antenna structure for connecting to a transceiver, said method comprising the steps of:

a) forming a printed circuit board for providing an insulative substrate for said antenna structure, said printed circuit board having first and second sides and distal and proximal ends;

b) forming on said printed circuit board a planer electromagnetic radiating element having distal and proximal ends and affixed to said first side of said printed circuit board, said distal end of said radiating element being positioned on said distal end of said printed circuit board and said proximal end of said radiating element being positioned on said proximal end of said printed circuit board, said radiating element capable of electrical coupling to said transceiver;

c) overmolding at least a portion of both said distal end of said printed circuit board and said distal end of said radiating element affixed thereto forming an integral one-piece overmolded sheath at a distal portion of said antenna structure; and d) forming an antenna housing coupled about both said proximate portion of said printed circuit board and said proximate portion of said planer electromagnetic radiating element forming a proximate end of said antenna structure.

10. The method for forming an antenna structure for connecting to a transceiver, as recited in claim 9, further comprising the step of:

a) forming a ground plane affixed to said second side of said printed circuit board for electrically connecting to said transceiver.

11. The method for forming an antenna structure for connecting to a transceiver, as recited in claim 9, further comprising the step of:

a) attaching a connector electrically coupled to said planer electromagnetic radiating element and physically mounted to said printed circuit board for cabling to said transceiver.

12. The method for forming an antenna structure for connecting to a transceiver, as recite in claim 9, further comprising the step of:

a) supporting said distal end of said printed circuit board from deflection during said overmolding step.

13. The method for forming an antenna structure for connecting to a transceiver, as recited in claim 9, wherein said forming on said printed circuit board a planer electromagnetic radiating element, comprises the step of:

a) etching said planer electromagnetic radiating element from a metallic plane on said first side of said printed circuit board.

14. A transceiver structure for connecting with a host system, comprising:

a) a transceiver for transmitting and receiving between said host system and a wireless network; and b) an antenna structure mechanically and electrically coupled to said transceiver comprising:

i) a printed circuit board having first and second sides and distal and proximal ends;

ii) a planer electromagnetic radiating element having distal and proximal ends and affixed to said first side of said printed circuit board, said distal end of said radiating element being positioned on said distal end of said printed circuit board and said proximal end of said radiating element being positioned on said proximal end of said printed circuit board, said radiating element capable of electrical coupling to said transceiver;

iii) an integral one-piece overmolded sheath that encapsulates both at least a portion of said distal end of said printed circuit board and at least a portion of said distal end of said radiating element affixed thereto forming a distal portion of said antenna structure; and iv) an antenna housing coupled about both said proximate portion of said printed circuit board and said proximate portion of said planer electromagnetic radiating element and abutting said overmolded sheath forming a proximate end of said antenna structure.

15. The transceiver structure as recited in claim 14, wherein said overmolded sheath is comprised of injection molded plastic.

16. The transceiver structure as recited in claim 15, wherein said molded plastic is a thermoplastic elastomer plastic.

17. The transceiver structure as recited in claim 15, wherein said molded plastic is a urathane-based plastic.

18. The transceiver structure as recited in claim 14, wherein said planer electromagnetic radiating element further comprises:

a) a ground plane affixed to said second side of said printed circuit board for electrically connecting to said transceiver.

19. The transceiver structure as recited in claim 14, wherein said electromagnetic radiating element further comprises:

a) an interconnect trace electrically connected from said proximal end of said planer radiating element to said proximal end of said printed circuit board for electrically connecting said planer electromagnetic radiating element to said proximal end of said printed circuit board for electrically coupling to said transceiver.

20. The transceiver structure as recited in claim 19, wherein a) said planer electromagnetic radiating element and said interconnect trace are proportional for operation of said transceiver at the frequency bands about 2.4 GHz.

* * * * *